US006052511A

United States Patent [19]

Birdsell

[11] Patent Number: 6,052,511

[45] Date of Patent: Apr. 18, 2000

[54] HUMIDIFIER WITH REMOVABLE WATER SUPPLY TANK

[75] Inventor: Walter Birdsell, Shrewsbury, Mass.

[73] Assignee: Honeywell Inc., Minneapolis, Minn.

[21] Appl. No.: 09/216,511

[22] Filed: Dec. 18, 1998

[51] Int. Cl.[7] ..... B05B 1/24

[52] U.S. Cl. ..... 392/406; 392/386; 392/404

[58] Field of Search ..... 392/386, 394, 392/403, 404, 405, 406, 441, 443, 444; 261/119.1, DIG. 65; 220/771, 670, 671; 215/382, 383, 384

[56] References Cited

U.S. PATENT DOCUMENTS

| | | | |
|---|---|---|---|
| 3,236,746 | 2/1966 | Poindexter et al. | 392/406 |
| 3,546,428 | 12/1970 | Omohundro | 392/404 |
| 4,752,423 | 6/1988 | Wong | 392/405 |
| 4,906,417 | 3/1990 | Gentry | 392/405 |
| 5,247,604 | 9/1993 | Chiu | 392/406 |
| 5,339,383 | 8/1994 | Marino | 392/406 |
| 5,483,616 | 1/1996 | Chiu et al. | 392/406 |
| 5,611,967 | 3/1997 | Jane et al. | 392/405 |
| 5,859,952 | 1/1999 | Levine et al. | 392/405 |

*Primary Examiner*—Teresa Walberg
*Assistant Examiner*—Fadi H. Dahbour
*Attorney, Agent, or Firm*—John E. Toupal; Harold G. Jarcho

[57] ABSTRACT

A portable humidifier including a base defining a reservoir for liquid; a humidification mechanism for drawing moisture from the reservoir and discharging the moisture into the environment; and a tank removably supported by the base and having an outlet communicating with the reservoir; the tank having a bottom wall, a top wall, a front wall, a back wall, a first side wall joining one edge of the front wall and one edge of the back wall, and a second side wall joining another edge of the front wall and another edge of the back wall; and wherein the front wall defines a substantially vertical first groove extending substantially parallel to and adjacent to the one edge of the front wall and a substantially vertical second groove extending substantially parallel to and adjacent to the another edge of the front wall; and the back wall defines a substantially parallel third groove extending substantially parallel to and adjacent to the one edge of the back wall, and a substantially vertical fourth groove extending substantially parallel to and adjacent to the another edge of the back wall.

22 Claims, 5 Drawing Sheets

HUMIDIFIER WITH REMOVABLE WATER SUPPLY TANK

BACKGROUND OF THE INVENTION

This invention relates generally to a portable humidifier and, more specifically, to a portable humidifier with an improved removable water tank.

Various types of humidifiers are used to provide moisture to indoor air. Included among such humidifiers are ultrasonic humidifiers, steam humidifiers, or vaporizers, and evaporative humidifiers. Many such humidifiers employ a removable water storage tank which can be removed for filling. Typically, a bottom wall of the storage tank is provided with a valve assembly which regulates water flow to maintain a desired water level in a reservoir supplying a humidification device. Such a removable storage tank is disclosed, for example in U.S. Pat. Nos. 5,210,818 and 5,247,604. The tank is sealed and includes a carrying handle on its top surface while a bottom surface includes an opening to which a cap is attached. When the tank is inverted beneath a spigot and the cap is removed the opening serves as a fill opening. Often the cap includes a valve system which seals the fill opening unless the tank is properly positioned on a humidifier base and the valve is engaged by a valve actuator in the base. The valve acutator opens the valve and allows water to escape from the tank into a reservoir defined by the base. Discharging water is exchanged for air which enters the tank through the same opening. As water flows into the base reservoir, the water level rises until it seals the valve and prevents air from getting into the tank. At this level, which is the normal operating water level for the humidifier, water flow from the tank ceases.

An improved removable humidifier water storage tank is disclosed in U.S. Pat. No. 5,483,616. That storage tank is provided with a carrying handle on each of its top and bottom surfaces to facilitate easier handling during filling operations. In addition, an added lower handle protects a regulator valve from damage and prevents leakage during transport of the storage tank. However, in certain cases handling of this storage tank also can be troublesome.

It is the object of the present invention to overcome the deficiencies of the prior art and provide a humidifier tank which can be more easily handled during transport required for tank filling operations.

SUMMARY OF THE INVENTION

The invention is a portable humidifier including a base defining a reservoir for liquid; a humidification mechanism for drawing moisture from the reservoir and discharging the moisture into the environment; and a tank removably supported by the base and having an outlet communicating with the reservoir; the tank having a bottom wall, a top wall, a front wall, a back wall, a first side wall joining one edge of the front wall and one edge of the back wall, and a second side wall joining another edge of the front wall and another edge of the back wall; and wherein the front wall defines a substantially vertical first groove extending substantially parallel to and adjacent to the one edge of the front wall and a substantially vertical second groove extending substantially parallel to and adjacent to the another edge of the front wall; and the back wall defines a substantially parallel third groove extending substantially parallel to and adjacent to the one edge of the back wall, and a substantially vertical fourth groove extending substantially parallel to and adjacent to the another edge of the back wall. The first, second, third and fourth grooves accommodate fingers of two hands to facilitate handling of the tank during liquid filling procedures.

According to one feature of the invention, the humidifier includes a primary handle disposed on the top wall. The primary handle facilitates handling when the tank is being moved from a location of use to a filling facility.

According to another feature of the invention, the outlet is disposed on the bottom wall, and an auxiliary handle also is disposed on the bottom wall. The auxiliary handle facilitates handling when the tank is being filled through the outlet.

According to other features of the invention, the top wall is substantially planar with a recess retaining the primary handle; and the bottom wall is formed by a substantially planar first surface and a substantially planar second surface parallel to the first surface and vertically spaced therefrom, the first surface defines a recess retaining the auxiliary handle, and the outlet is defined by a threaded sleeve projecting downwardly from the second surface. The recesses prevent inadvertent collisions of the handles with other objects and the threaded sleeve accommodates a valve assembly for regulating liquid flow into the reservoir.

According to a further feature of the invention, the front wall and the back wall each have a given width; and each of the first, second, third and fourth grooves have a width less than ⅛ of the given width. The grooves of limited width provide surfaces which enhance finger gripping of the tank.

According to an additional feature of the invention, each of the first, second, third and fourth grooves are spaced from the respective edges by a distance less than ⅛ of the given width. The limited spacing of the grooves from the edges facilitates access to the grooves by fingers on hands positioned adjacent to the side walls of the tank.

According to still other features of the invention, each of the first and second grooves extend over substantially the entire length of the front wall, and each of the third and fourth grooves extend over substantially the entire length of the back wall. These features simplify location of the grooves by fingers while handling the tank.

DESCRIPTION OF THE DRAWINGS

These and other objects and features of the invention will become more apparent upon a perusal of the following description taken in conjunction with the accompanying drawings wherein.

DESCRIPTION OF THE PREFERRED EMBODIMENT

Figure 1:
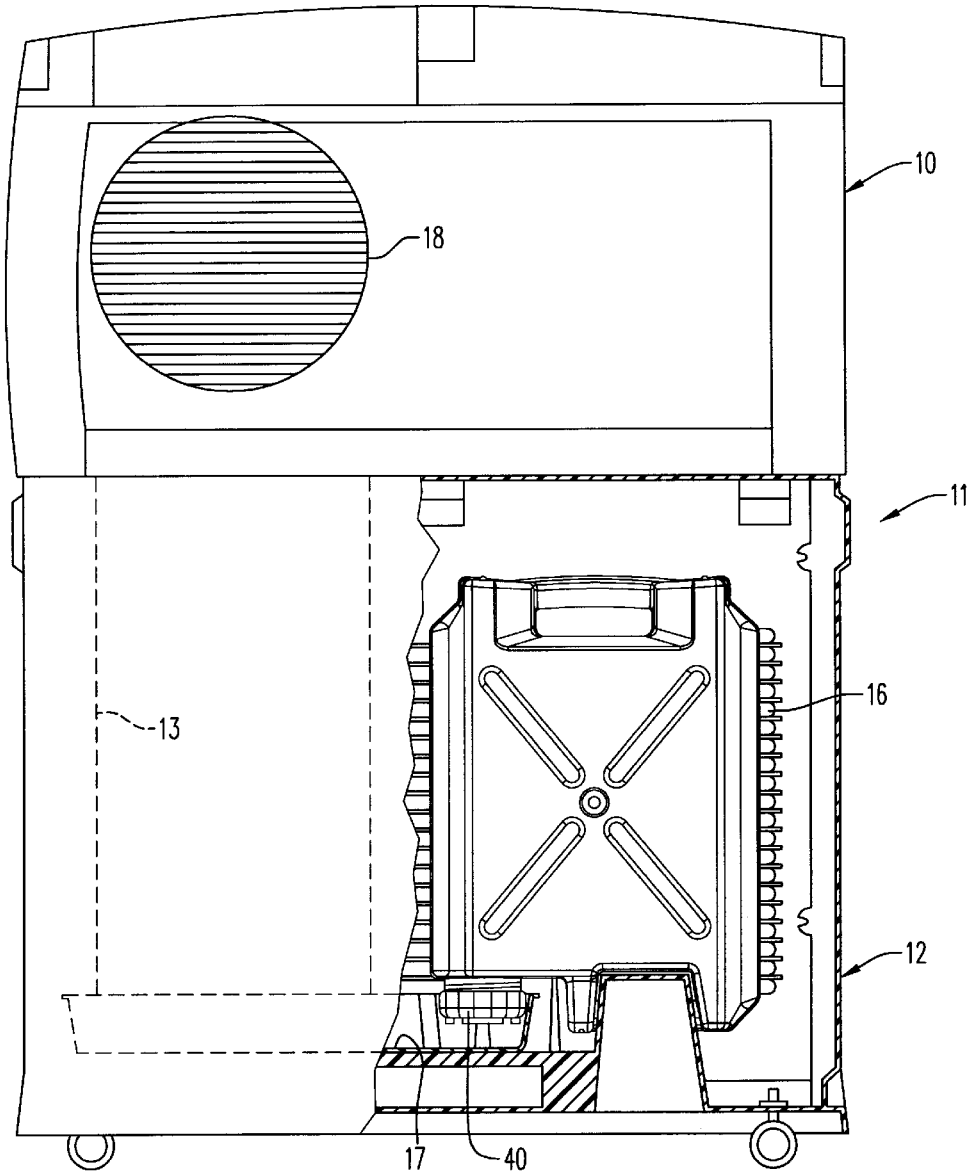
FIG. 1 is an elevational view of a humidifier according to the invention.
Figure 2:
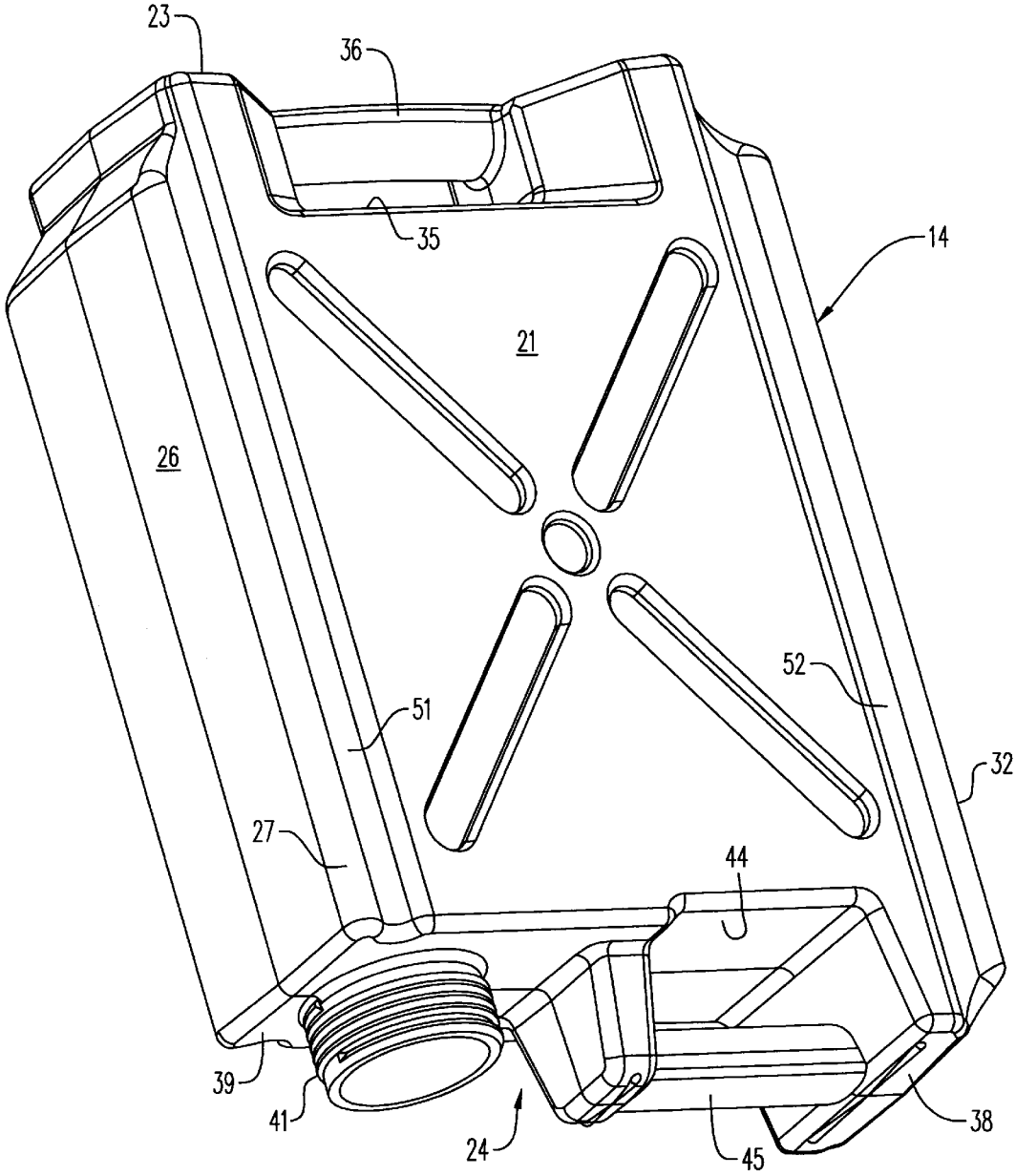
FIG. 2 is a front perspective view of a removable supply tank used with the humidifier shown in FIG. 1.
Figure 3:
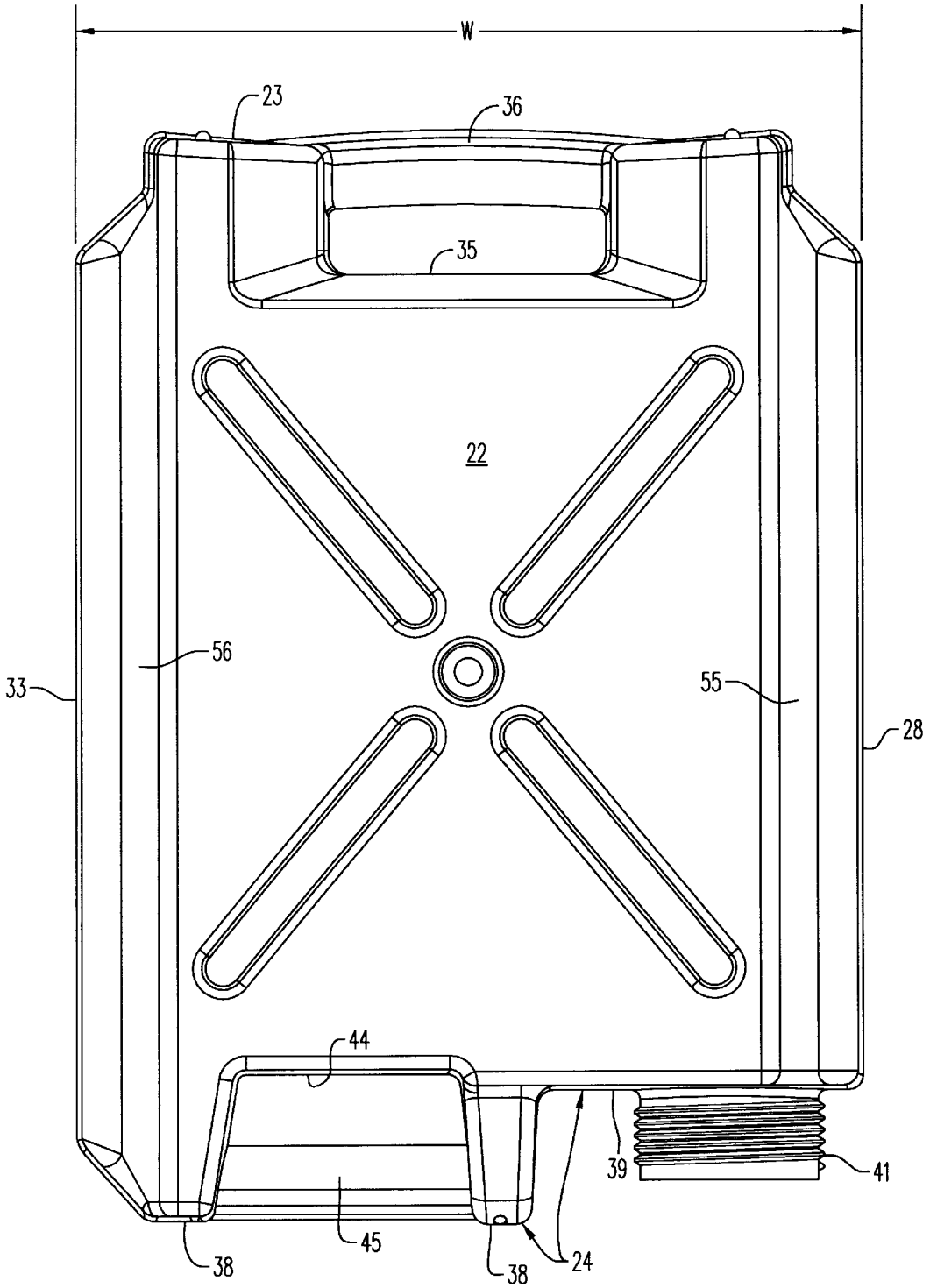
FIG. 3 is a rear view of the supply tank.
Figure 5:
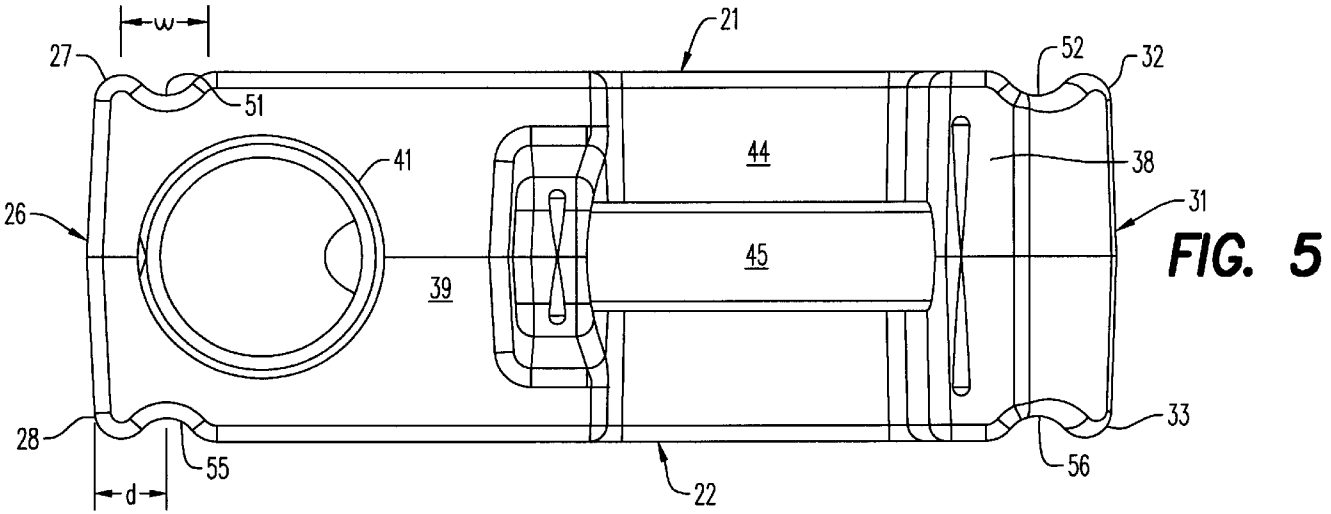
FIG. 5 is a bottom view of the supply tank.
Figure 4:
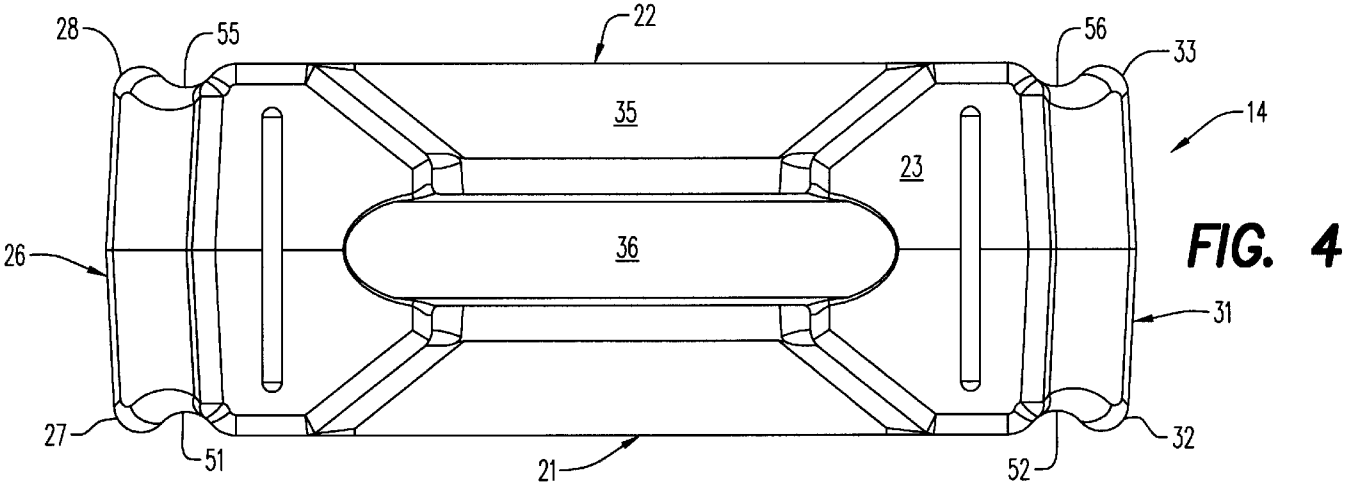
FIG. 4 is a top view of the supply tank.
Figure 6:
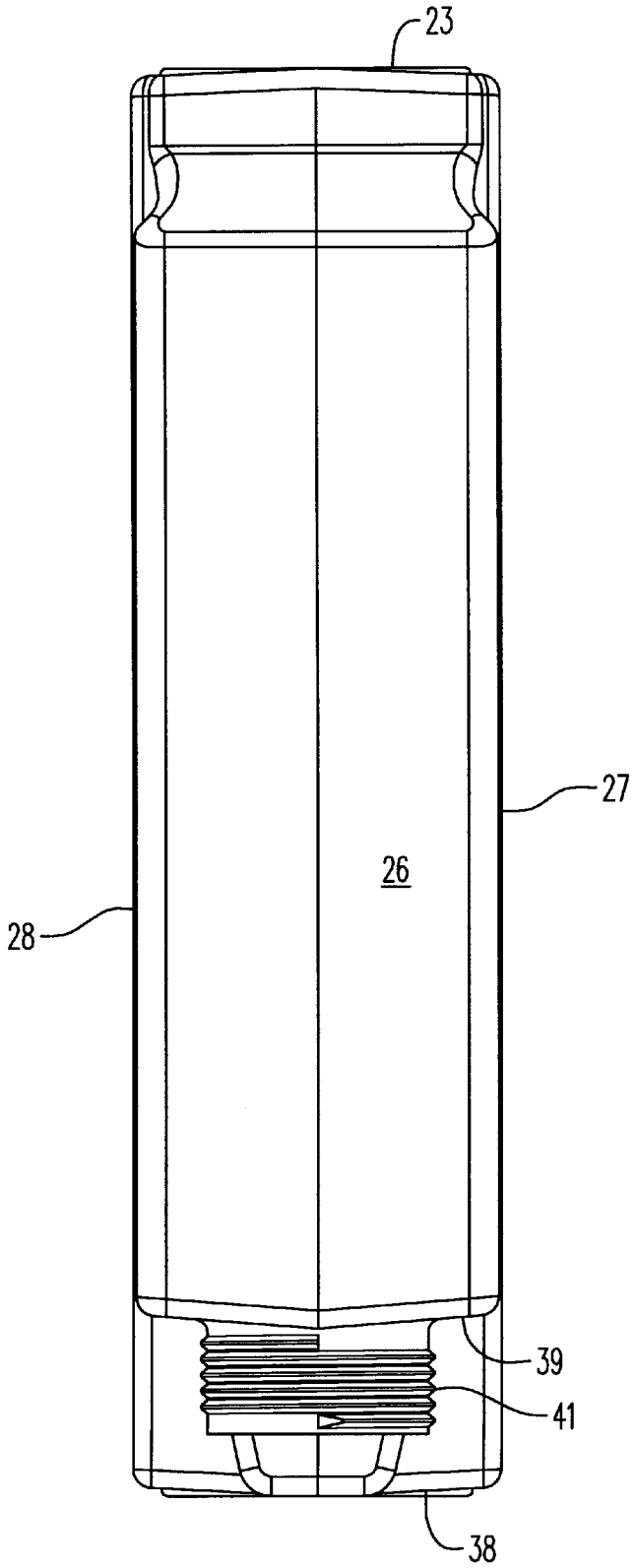
FIG. 6 is a left side view of the supply tank.

A humidifier 11 includes a base 12 with a hinged cover 10. Mounted in juxtaposed positions on the base 12 are a humidification unit 13 and a removable liquid storage tank 14. The humidifier 11 has an air inlet 16 formed in a rear wall of the base 12 and an outlet 18 for dispersing moisture into a surrounding environment and formed in the cover 10. Defined by the base 12 is an internal reservoir 17 that receives water gradually discharged by the storage tank 14. The humidification unit 13 and associated reservoir 17 can be of any conventional type including for example, those shown in above noted U.S. Pat. No. 5,483,616.

Referring now to FIGS. 2–7, the supply tank 14 has a front wall 21, a back wall 22, a top wall 23 and a bottom wall 24. A first side wall 26 joins one vertical edge 27 of the front wall 21 with one vertical edge 28 of the back wall 22. In addition, a second side wall 31 joins another vertical edge 32 of the front wall 22 to another vertical edge 33 of the back wall 22. The substantially planar top wall 23 defines a centrally located recess 35 which retains a primary handle 36. Conversely, the bottom wall 24 is formed by vertically spaced apart first and second planar surfaces 38 and 39. An externally threaded sleeve 41 projects downwardly from the second surface 39 and defines an outlet for discharging water into the reservoir 17. During use of the tank 14, the threaded sleeve 41 receives a conventional cap 40 (FIG. 1) having a valve (not shown) providing a regulated flow of water to the reservoir 17. The cap 40 can be, for example, of the type shown in U.S. Pat. No. 5,483,616. Defined in a central location of the first planar surface 38 is a recess 44 that retains an auxiliary handle 45.

The front wall 21 defines a first vertical groove 51 disposed closely adjacent and parallel to the one end edge 27 and extending the full length of the front wall 21. A second groove 52 is formed closely adjacent and parallel to the another edge 32 of the front wall 21 and also extends for the entire length thereof. Preferably, each of the first and second grooves 51, 52 has a width w less than ⅛ the full width W of the front wall 21. In addition, each of the first and second grooves 51, 52 preferably is spaced from, respectively, the one and another edges 27, 32 by a distance d less than ⅛ of the full width W of the front wall 21.

The back wall 22 defines a third vertical groove 55 extending closely adjacent and parallel to its one edge 28 and a fourth vertical groove 56 extending closely adjacent and parallel to its another edge 33. Each of the third and fourth grooves 55, 56 extend over the full length of the back wall 22. Preferably, the third and fourth grooves 55, 56 are spaced from, respectively, the one and another edges 28, 33 less than ⅛ the full width W of the back wall 22. Also, the width of the third and fourth grooves 55, 56 preferably are equal to the width of the first and second grooves 51, 52 and less than ⅛ the full width W of the back wall 22.

During use of the humidifier 11, the removable supply tank 14 is used to maintain a constant source of water for humidification. After each exhaustion of its water contents, the tank 14 is removed from the base 12 and transported to a suitable water tap. The tank 14 is then inverted and a cap (not shown) removed from the threaded outlet sleeve 41. After re-filling of the tank 14, the cap (not shown) is replaced on the threaded outlet sleeve 41 and the tank is carried back to the humidifier 11 and positioned appropriately on the base 12. During each re-filling procedure, a user can employ the primary and auxiliary handles 36, 45 as desired. In addition, handling of the tank 14 is facilitated by the grooves 51, 52, 55, and 56 which allow lifting of the tank 14 with both hands. One edge of the tank 14 is gripped by one hand by placing a thumb in the first groove 51 on the front wall 21 and fingers in the third groove 55 on the back wall 22. Similarly, another hand can grip the opposite edge of the tank 14 by placement of a thumb in the second groove 52 on the front wall 21 and fingers in the fourth groove 56 on the back wall 22.

Obviously, many modifications and variations of the present invention are possible in light of the above teachings. It is to be understood, therefore, that the invention can be practiced otherwise than as specifically described.

What is claimed is:

1. A portable humidifier comprising:

a base defining a reservoir for liquid;

humidification means for drawing moisture from said reservoir and discharging the moisture into the environment; and a tank removably supported by said base and having an outlet communicating with said reservoir; said tank having a bottom wall, a top wall, a front wall, a back wall, a first side wall joining one edge of said front wall and one edge of said back wall, and a second side wall joining another edge of said front wall and another edge of said back wall; said front wall defining a substantially vertical first groove extending substantially parallel to and along the length of said one edge of said front wall and a substantially vertical second groove extending substantially parallel to and along the length of said another edge of said front wall; and said back wall defining a substantially parallel third groove extending substantially parallel to and along the length of said one edge of said back wall, and a substantially vertical fourth groove extending substantially parallel to and along the length of said another edge of said back wall; and wherein said first, second, third and fourth grooves are shaped and arranged for being gripped by fingers during transport of said tank.

2. A humidifier according to claim 1 including an primary handle disposed on said top wall.

3. A humidifier according to claim 2 wherein said outlet is disposed on said bottom wall.

4. A humidifier according to claim 3 including an auxiliary handle disposed on said bottom wall.

5. A humidifier according to claim 4 wherein said tank is an integrally molded unit.

6. A humidifier according to claim 3 wherein said top wall is substantially planar with a recess retaining said primary handle.

7. A humidifier according to claim 6 including an auxiliary handle disposed on said bottom wall.

8. A humidifier according to claim 7 wherein said bottom wall is formed by a substantially planar first surface and a substantially planar second surface parallel to said first surface and vertically spaced therefrom, said first surface defines a recess retaining said auxiliary handle, and said outlet is defined by a threaded sleeve projecting downwardly from said second surface.

9. A humidifier according to claim 1 wherein said front wall and said back wall each have a given width; and each of said first, second, third and fourth grooves have a width less than ⅛ of said given width.

10. A humidifier according to claim 1 wherein each of said first, second, third and fourth grooves are spaced from said respective edges by a distance less than ⅛ of said given width.

11. A humidifier according to claim 1 wherein each of said first and second grooves extend over substantially the entire length of said front wall, and each of said third and fourth grooves extend over substantially the entire length of said back wall.

12. A removable liquid supply tank for a humidifier and comprising an opening for accommodating liquid flow, a bottom wall, a top wall, a front wall, a back wall, a first side wall joining one edge of said front wall and one edge of said back wall, and a second side wall joining another edge of said front wall and another edge of said back wall; said front wall defining a substantially vertical first groove extending substantially parallel to and along the length of said one edge of said front wall and a substantially vertical second groove extending substantially parallel to and along the length of said another edge of said front wall; and said back wall defining a substantially parallel third groove extending substantially parallel to and along the length of said one edge of said back wall and a substantially vertical fourth groove extending substantially parallel to and along the length of said another edge of said back wall; and wherein said first, second, third and fourth grooves are shaped and arranged for being gripped by fingers during transport of said tank.

13. A removable liquid supply tank according to claim 12 including a primary handle disposed on said top wall.

14. A removable liquid supply tank according to claim 13 wherein said opening is disposed on said bottom wall.

15. A removable liquid supply tank according to claim 14 including an auxiliary handle disposed on said bottom wall.

16. A removable liquid supply tank according to claim 15 wherein said tank is an integrally molded unit.

17. A removable liquid supply tank according to claim 14 wherein said top wall is substantially planar with a recess retaining said primary handle.

18. A removable liquid supply tank according to claim 17 including an auxiliary handle disposed on said bottom wall.

19. A removable liquid supply tank according to claim 18 wherein said bottom wall is formed by a substantially planar first surface and a substantially planar second surface parallel to said first surface and vertically spaced therefrom, said first surface defines a recess retaining said auxiliary handle, and said opening is defined by a threaded sleeve projecting downwardly from said second surface.

20. A removable liquid supply tank according to claim 12 wherein said front wall and said back wall each have a given width; and each of said first, second, third and fourth grooves have a width less than ⅛ of said given width.

21. A removable liquid supply tank according to claim 20 wherein each of said first, second, third and fourth grooves are spaced from said respective edges by a distance less than ⅛ of said given width.

22. A removable liquid supply tank according to claim 12 wherein each of said first and second grooves extend over substantially the entire length of said front wall, and each of said third and fourth grooves extend over substantially the enitre length of said back wall.

* * * * *